US009577360B2

(12) United States Patent
Kao et al.

(10) Patent No.: US 9,577,360 B2
(45) Date of Patent: Feb. 21, 2017

(54) ELECTRICAL CONNECTOR HAVING HOLDING PIECES WITH A NOTCH FOR HOLDING A CIRCUIT BOARD

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Long-Fei Chen, New Taipei (TW); Yang-Yang Zhou, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/152,878

(22) Filed: May 12, 2016

(65) Prior Publication Data

US 2016/0344122 A1 Nov. 24, 2016

(30) Foreign Application Priority Data

May 20, 2015 (CN) ..... 2015 1 0257610

(51) Int. Cl.

| | |
|---|---|
| ***H01R 13/64*** | (2006.01) |
| ***H01R 12/72*** | (2011.01) |
| ***H01R 24/64*** | (2011.01) |
| *H01R 107/00* | (2006.01) |

(52) U.S. Cl.

CPC ..... *H01R 12/722* (2013.01); *H01R 13/64* (2013.01); *H01R 24/64* (2013.01); *H01R 2107/00* (2013.01)

(58) Field of Classification Search

CPC ..... H01R 12/7005; H01R 12/7011; H01R 12/7029;H01R 13/64; H01R 13/642; H01R 13/6587; H01R 13/6594; H01R 23/6873; H01R 23/7073

USPC ..... 439/374, 377, 607.4

See application file for complete search history.

(56) References Cited

U.S. PATENT DOCUMENTS

| | | | | | |
|---|---|---|---|---|---|
| 5,842,885 | A * | 12/1998 | Takamoto | H01R 23/6873 | 439/60 |
| 6,056,583 | A * | 5/2000 | Lee | H01R 12/7005 | 439/157 |
| 6,315,263 | B1 * | 11/2001 | Wang | H05K 7/1431 | 248/346.3 |
| 6,767,230 | B2 * | 7/2004 | Lai | H01R 12/7029 | 439/153 |
| 7,637,768 | B1 * | 12/2009 | Hsu | H01R 43/26 | 439/374 |
| 8,033,837 | B2 * | 10/2011 | Yang | H01R 12/724 | 439/607.4 |

(Continued)

*Primary Examiner* — Chandrika Prasad
(74) *Attorney, Agent, or Firm* — Rosenberg, Klein & Lee

(57) ABSTRACT

An electrical connector has a base, a terminal set, a pair of holding pieces, an insulating body and a shell. The base has two holding piece slots respectively formed in two sides of the bottom of base. The pair of holding pieces is assembled into the holding piece slots respectively. Each holding piece is C-shaped and has a notch formed in a rear end of the holding piece and serving to hold a PCB board. A front end of each holding piece is assembled into the base. Given the pair of holding pieces with an assemblable structure, the size of the holding pieces can be tailored to the requirement of customers. The shell is formed by a two-stage of drawing process to enhance overall strength of the shell to facilitate the plating process afterwards.

12 Claims, 10 Drawing Sheets

(56) References Cited

U.S. PATENT DOCUMENTS

| | | | | |
|---|---|---|---|---|
| 8,348,694 | B2 * | 1/2013 | Kah | H01R 12/724 439/374 |
| 9,496,653 | B2 * | 11/2016 | Little | H01R 13/6581 |
| 2002/0081890 | A1 * | 6/2002 | Obermaier | H05K 7/1451 439/377 |
| 2012/0295469 | A1 * | 11/2012 | Takeda | H01R 12/724 439/377 |
| 2014/0220812 | A1 * | 8/2014 | Sasada | G06K 7/003 439/377 |

* cited by examiner

ELECTRICAL CONNECTOR HAVING HOLDING PIECES WITH A NOTCH FOR HOLDING A CIRCUIT BOARD

BACKGROUND OF THE INVENTION

1. Field of the Invention

The present invention relates to an electrical connector, and more particularly to an electrical connector capable of being assembled with a pair of holding pieces.

2. Description of the Prior Art

Electrical connectors are widely used in electronic devices nowadays. In view of booming 3C smart devices, everyone seems to have possession of one smart device. As such, electrical connectors become an essential and critical electronic element for 3C smart device. Conventional electrical connectors having the USB (Universal Serial Bus) type-C connector are taken as the electrical connectors for the specification of USB 3.0 and other later revisions. What worth mentioning about USB 3.0 is its support of forward and reverse plug for ensuring normal operation regardless of whether a USB type-C plug is plugged in a USB type-C socket forwardly or reversely. Furthermore, USB 3.0 is advantageous in much faster transmission speed while the circuit board connected with a USB 3.0 connector has higher power consumption than that connected with a connector with an earlier revision. This is the reason why the USB 3.0 connector is connected with circuit boards operated under a higher power environment.

With reference to FIG. 9, a conventional USB 3.0 type-C plug includes a shell 12 and a pair of holding legs 14. The shell 12 is made of iron or other alloy. The pair of holding legs 14 is formed on a back side of the shell 12 with left-right symmetry. The holding legs 14 are used to hold a PCB (Printed Circuit Board) 16. The PCB board 16 is an electrical element in connection with the conventional USB 3.0 type-C plug. The drawback of the conventional USB 3.0 type-C plug is that the pair of holding legs 14 is integrally formed with the shell 12 and is a part of the shell 12. When subject to a drawing process, the shell 12 needs to undergo additional processes, such as trimming and bending in generation of elbows, for manufacture of the pair of holding legs 14 as shown in FIG. 9. However, due to collision, it is easy for the pair of holding legs 14 to be not held in place when the PCB board 16 is plugged in the pair of holding legs 14. An insertion gap between an upper portion and a lower portion of the pair of legs 14 is widened because of the insertion of the PCB board 16. What is worse is that the conventional USB 3.0 type-C connector may become useless when the pair of holding legs 14 is damaged and fails to clamp the PCB board 16 tightly.

The present invention thus develops an electrical connector to mitigate or solve the problems mentioned above.

SUMMARY OF THE INVENTION

The main objective of the present invention is to provide an electrical connector having a pair of holding pieces assembled with the electrical connector and tailored to customer's demand in terms of size options and a shell formed by a two-stage drawing process to enhance the overall strength of the shell and facilitate the electroplating afterwards.

To achieve the objective above, the electrical connector includes a base, a terminal set, a pair of holding pieces, an insulating body and a shell.

The base has two holding piece slots respectively formed in both sides of the base.

The terminal set has multiple terminals with one end of each terminal mounted inside the base.

Each holding piece has a notch formed in a rear end thereof for holding a circuit board. A front end of each holding piece is mounted into one of the two holding piece slots of the base.

The insulating body has an insertion space to receive the terminal set. One end of the insulating body is connected with the base.

The shell has a rear end, a housing space, a front drawing portion and a rear drawing portion.

The rear end is combined with the base.

The housing space is defined inside the shell to receive the insulating body.

The rear drawing portion is formed on a rear end of the front drawing portion.

Given the holding pieces capable of being assembled into the base, the holding pieces can firmly hold a PCB (Printed Circuit Board) without being shoved away. Furthermore, the shell is formed by a two-stage drawing process, not only enhancing the overall strength of the shell, but also facilitating the plating process afterwards. Due to the simple two-stage drawing process, the electrical connector can be produced without any trimming or bending process.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
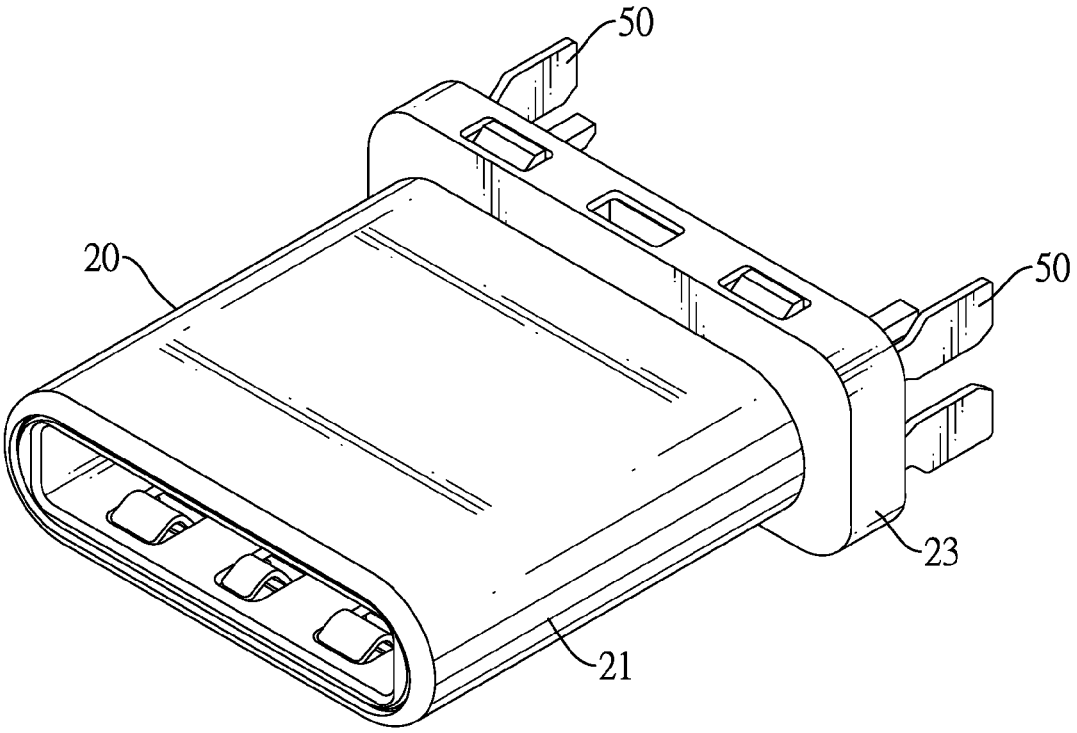
FIG. 1 is a perspective view of an embodiment of an electrical connector in accordance with the present invention.

The present invention is to provide an electrical connector having a pair of holding pieces to be assembled with the electrical connector and a shell formed by a two-stage drawing process.

With reference to FIGS. 1 to 5, a first embodiment of an electrical connector in accordance with the present invention includes a shell 20, an insulating body 30, a base 40, a pair of holding pieces 50, a terminal set 60 and a shielding piece 70.

The shell 20 is made of metal and the material of the shell 20 may include but is not limited to iron, compound of iron or alloy. The shell 20 is formed by a two-stage drawing process and a punch press process in generation of a front drawing portion 21 and a rear drawing portion 23. The rear drawing portion 23 is ring-shaped and is connected to a rear end of the front drawing portion 21. The front drawing portion 21 and the rear drawing portion 23 may be integrally formed.

Figure 2:
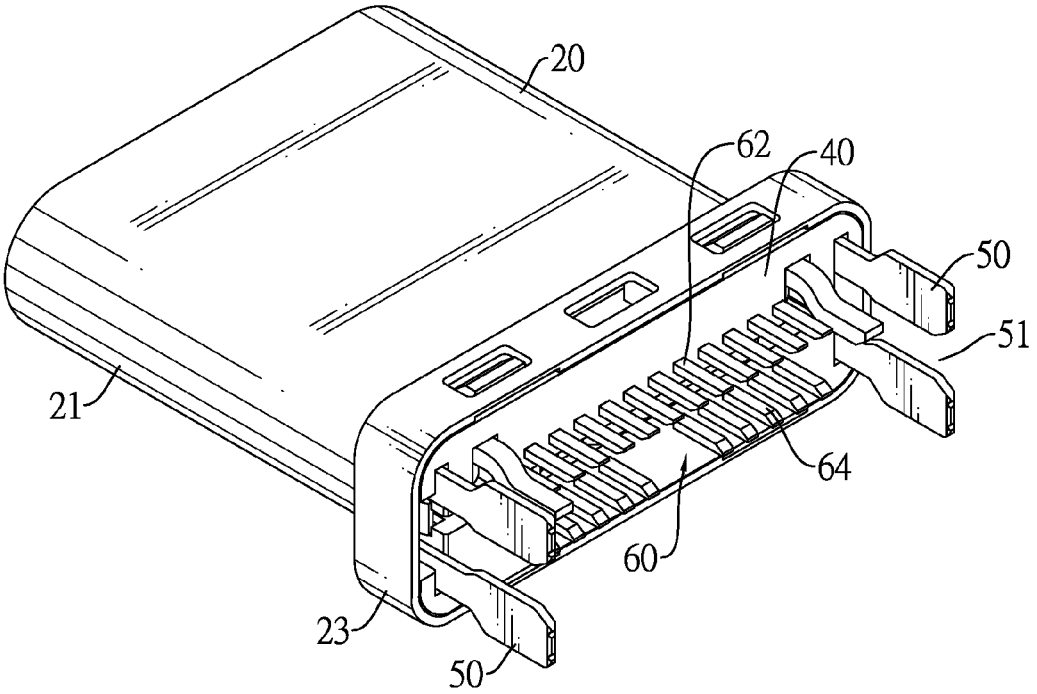
FIG. 2 is another perspective view of the electrical connector in FIG. 1.

The rear drawing portion 23 is integrally formed and takes the form of a ring shape as shown in FIG. 1 and FIG. 2. A cross-sectional area of the rear drawing portion 23 is larger than that of the front drawing portion 21. The front drawing portion 21 and the rear drawing portion 23 are integrally formed by the two-stage drawing process. There is no any leg on the shell 20, so the trimming and bending process can be omitted. On the other hand, the nature of the shell 20 made of iron or iron alloy provides a shielding effect against external noise.

The electrical connector has a pair of holding pieces. The pair of holding pieces shown in FIG. 1 has two holding pieces 50 symmetrically mounted on a left portion and a right portion of a rear side of the shell 20. Each holding piece 50 is C-shaped and has a notch 51 formed in a rear end of the holding piece 50. The notches 51 of the multiple holding pieces 40 are used to hold a PCB board. The holding piece 50 can be formed by a drawing process and a punch press process. The material of the holding pieces 50 includes but is not limited to the metal, alloy, or plastics.

Figure 4:
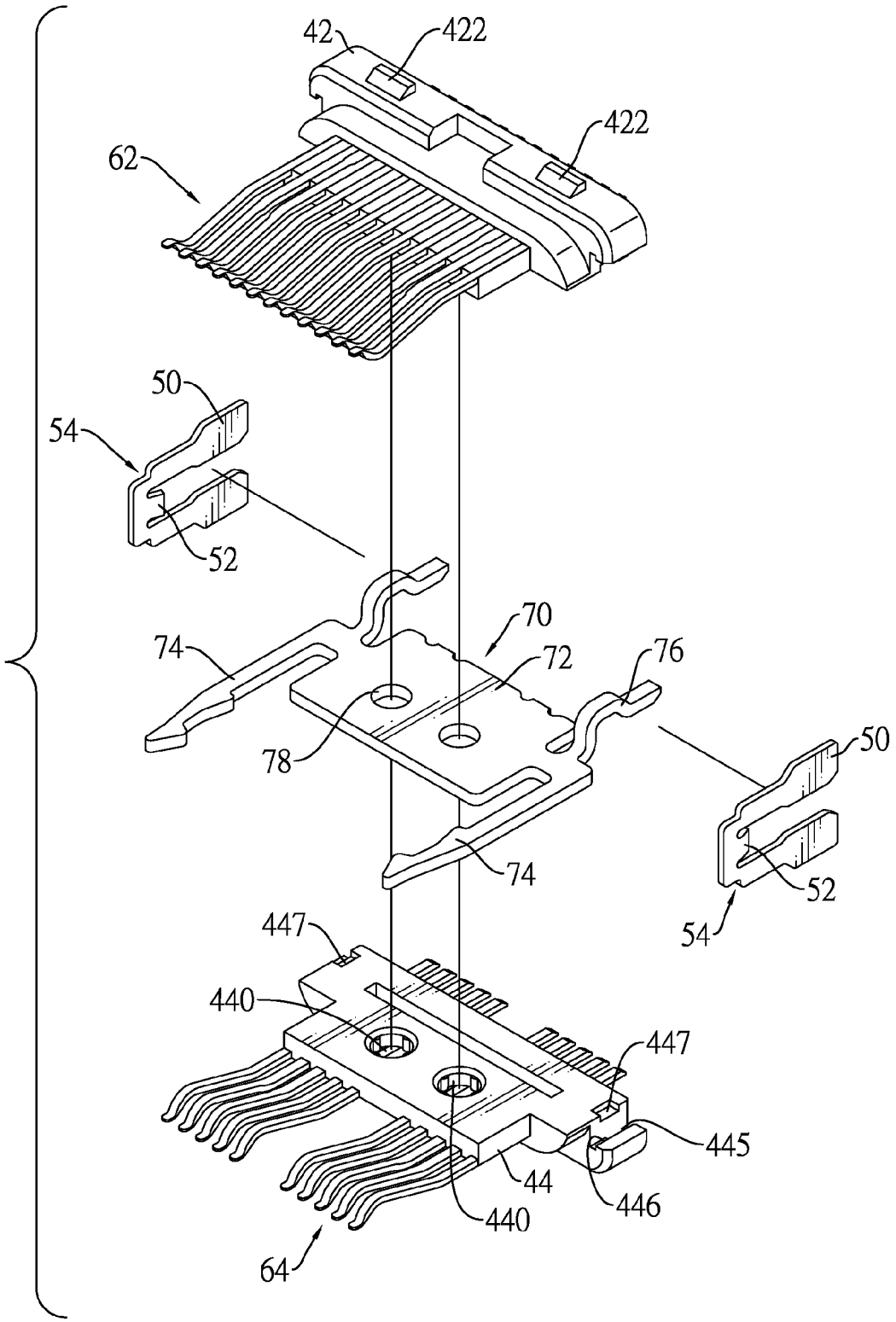
FIG. 4 is an exploded perspective view of the electrical connector in FIG. 1 with a base, a pair of holding pieces, a terminal set, and a shielding piece of the electrical connector in FIG. 1.
Figure 5:
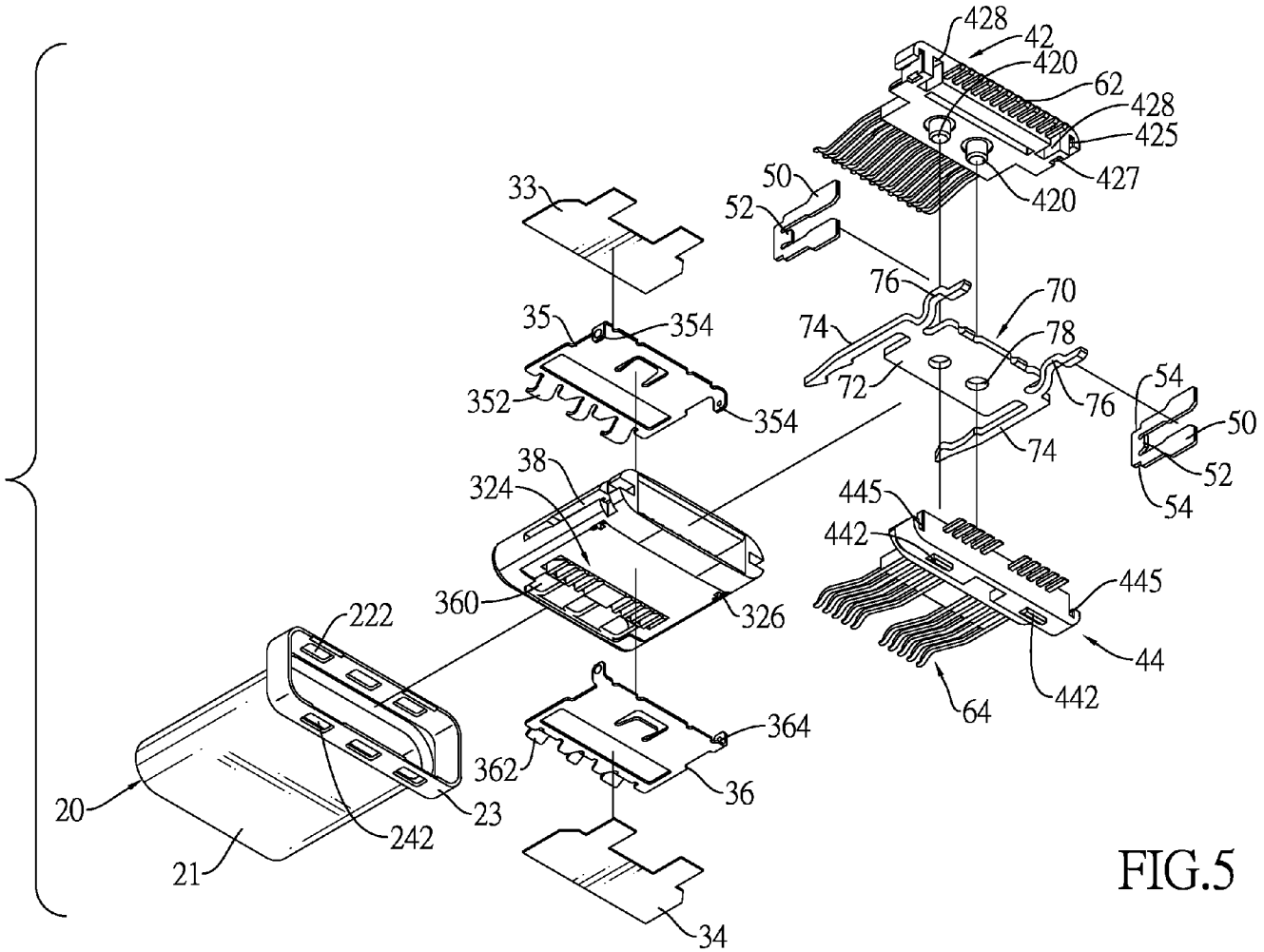
FIG. 5 is another exploded view of the electrical connector in FIG. 1.

With reference to FIGS. 2, 4 and 5, the base 40 include an upper base 42 and a lower base 44. The shielding piece 70 is held between the upper base 42 and the lower base 44. Each of the upper base 42 and the lower base 45 has a pair of holding piece slots 425, 445 respectively formed in a left portion and a right portion on a rear end of a corresponding one of the upper base 42 and the lower base 44. When the two holding pieces 50 are mounted in the base 40, a front end of each holding piece 50 is mounted in a corresponding pair of holding piece slots 425, 445. In the present embodiment, the two holding pieces 50 are securely mounted through the base 40.

With reference to FIG. 2, the terminal set 60 includes an upper terminal set 62 and a lower terminal set 64. Each of the upper terminal set 62 and the lower terminal set 64 has multiple terminals. These multiple terminals of the electrical connector serve to transmit electronic signals between the connector and a smart device. With reference to FIG. 4, because the terminals of the lower terminal set 64 and the upper terminal set 62 are mounted according to left-right symmetry and four central power terminals D+ and D− of the lower terminal set 64 and the upper terminal set 62 are alternately symmetric, the two central terminals of the lower terminal set 64 can be omitted. In other words, the terminal numbers of the lower terminal set 64 are less than that of the upper terminal set 62. The cost of the electrical connector in accordance with present invention is thus decreased due to the less metal material used by the electrical connector.

With reference to FIGS. 4 and 5, the upper base 42 has a pair of round columns 420 formed on an inner surface of the upper base 42, and the lower base 44 has a pair of circular slots 440 formed in the inner surface of the lower base 44 to correspond to the round columns 420. The shielding piece 70 includes a body 72, two elastic inserts 74, two fixing parts 76 and two circular holes 78. The two elastic inserts 74 are respectively and forwardly elongated from a left side and a right side of the body 72. Each of the two fixing parts 76 includes a curved portion and a flat portion. The two circular holes 78 are formed through the body 72.

The round columns 420 are mounted through the two circular holes 78 of the body 72 and are inserted into the circular slots 440 of the lower base 44 for the shielding piece 70 to be fixed between the upper base 42 and the lower base 44. The material of the shielding piece 70 may include but is not limited to a metal material capable of preventing external noise from interfering with the upper terminal set 62 and the lower terminal set 64.

With reference to FIG. 5, the upper base 42 has a pair of fixing slots 428 respectively formed in the left portion and the right portion on the rear end of the upper base 42 to receive the respective curved portions of the fixing parts 76 of the shielding piece 70. One flat end of each of the upper terminal set 62 and the lower terminal set 64 is mounted through and protrudes rearwards beyond the upper base 42 and the lower base 44 the base 40. The flat portions of the fixing parts 76 are mounted through and protrude beyond the upper base 42. The flat portions of the fixing parts 76 that protrude beyond the base 40 are further connected with the PCB board. For example, the flat portions of the fixing parts 76 may be electrically welded to the PCB board to let for the electrical connector to be firmly combined with the PCB board.

Furthermore, the upper terminal set 62 and the lower terminal set 64 are respectively combined with the upper base 42 and the lower base 44 by an insert-molding process. The upper terminal set 62 and the upper base 42 are formed by the insert-molding process. The lower terminal set 64 and the lower base 44 are formed by the insert-molding process.

Figure 3A:
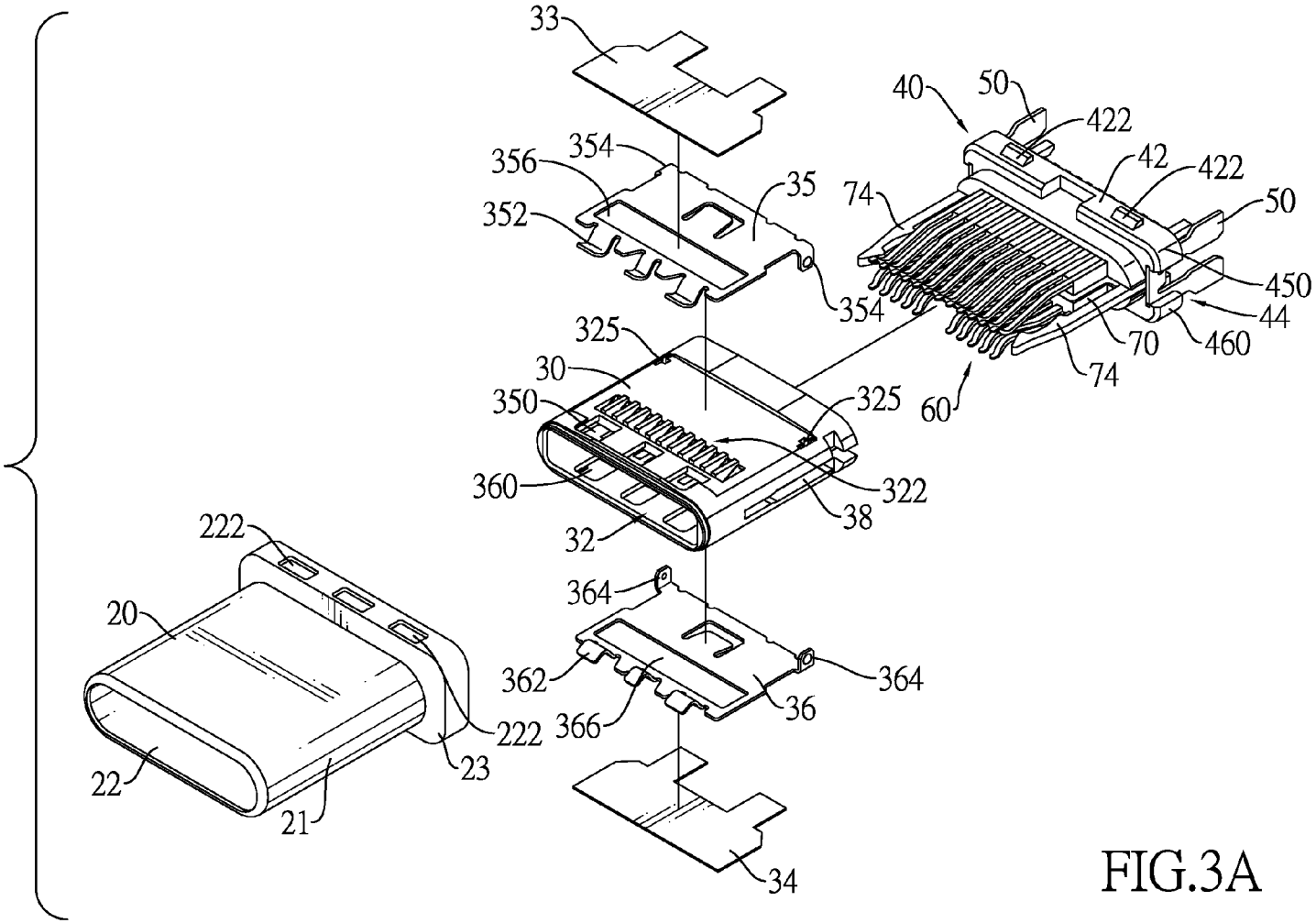
FIG. 3A is an exploded perspective view of the electrical connector in FIG. 1.

With reference to FIGS. 3A and 5, the insulating body 30 has an insertion space 32, multiple upper guiding slots 322, multiple lower guiding slots 324, multiple upper through holes 350, multiple lower through holes 360 and two assembling slot 38. The insertion space 32 is defined within the insulating body 30 to receive the terminal set 60. The multiple upper guiding slots 322 and the multiple lower guiding slots 324 are respectively formed in a top wall and a bottom wall of the insulating body 30. The multiple upper through holes 350 and the multiple lower through holes 360 are respectively formed through front portions of the top wall and the bottom wall of insulating body 30. The two assembling slots 38 are respectively formed in a left side and a right side of the insulating body 30.

A rear side of the insulating body 30 is combined with the base 40 by using the two elastic inserts 74 of the shielding piece are inserted into the two assembling slots 38 for the insulating body 30 and the base 40 be combined with each other. The insulating body 30 further has multiple rectangular holes to correspond to a number of the terminals of the upper terminal set 62 and the lower terminal set 64 for the terminals to be inserted therein. Curved ends of the upper terminal set 62 and the lower terminal set 64 pass through the insertion space 32 and are respectively mounted into the upper guiding slots 322 and the lower guiding slots 324 of the insulating body 30.

With reference to FIG. 3A, the electrical connector further includes an upper elastic seat 35, a lower elastic seat 36, an upper insulating film 33 and a lower insulating film 34. The upper and lower elastic seats 35, 36 are symmetrically placed on an upper surface and a lower surface of the insulating body 30 respectively. The insulating body 30 has multiple insertion holes 325, 326 formed in the top wall and the bottom wall of the insulating body 30. Each of the upper elastic seat 35 and the lower elastic seat 36 has multiple insertion tabs 354, 364 formed on two edge portion on the top wall of a corresponding one of the upper elastic seat 35 and the lower elastic seat 36. The insertion tabs 354, 364 are inserted into the respective insertion holes 325, 326, such that the upper elastic seat 35 and the lower elastic seat 36 can be fastened on the top wall and the bottom wall of the insulating body 30.

Each of the upper elastic seat 35 and the lower elastic seat 36 has multiple elastic pieces 352, 362 formed on a front end of a corresponding one of the upper elastic seat 35 and the lower elastic seat 36. The multiple elastic pieces 352, 362 are respectively mounted through the upper through holes 350 and the lower through holes 360. The multiple elastic pieces 352, 362 can hold a tongue piece of a female electrical connector when the electrical connector in accordance with the present invention is connected with the female electrical connector.

Figure 3B:
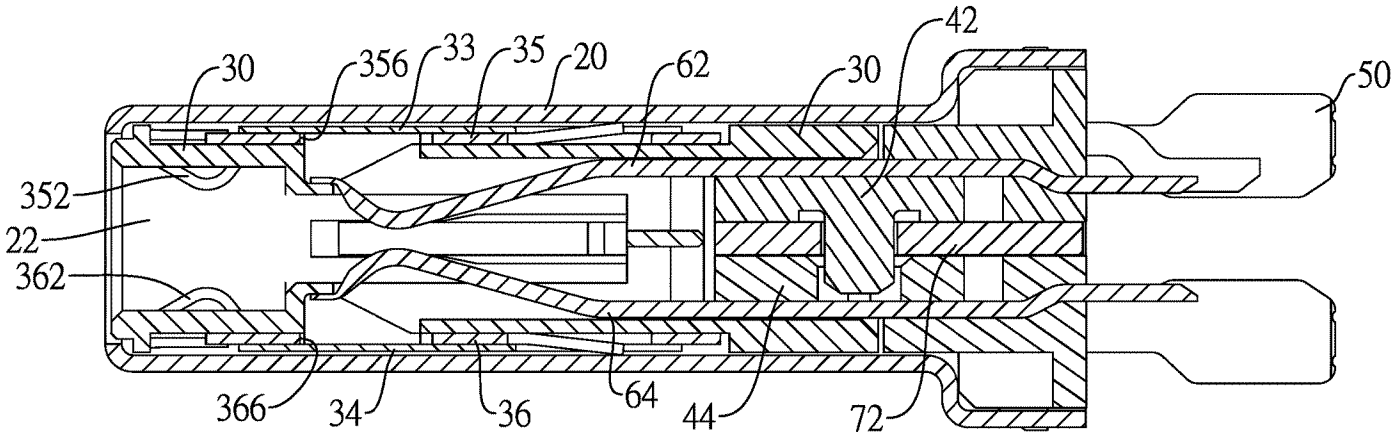
FIG. 3B is a cross-sectional view of the electrical connector in FIG. 1.

With reference to FIGS. 3A and 3B, the upper elastic seat 35 has an upper opening 356 formed through the upper elastic seat 35 and the lower elastic seat 36 has a lower opening 366 formed through the lower elastic seat 36. The upper insulating film 33 is placed on an upper surface of the upper elastic seat 35. The lower insulating film 34 is placed on the lower surface of the lower elastic seat 36. After the upper and lower elastic seats 35, 36 clamp the insulating body 30 according to vertical symmetry, the upper insulating film 33 and lower insulating film 34 are respectively placed on the upper elastic seat 35 and lower elastic seat 36 to cover the upper opening 356 of the upper elastic seat 35 and the lower opening 366 of the lower elastic seat 36, such that the upper insulating film 33 and the lower insulating film 34 can prevent terminals of the upper terminal set 62 and lower terminal set 64 from being exposed through the upper guiding slots 322 and the lower guiding slots 324 of the insulating body 30, which respectively correspond to the upper opening 356 and the lower opening 366.

With reference to FIGS. 3A and 5, the shell 20 has a housing space 22 defined inside the shell 20 to receive the insulating body 30. A rear side of the shell 20 is combined with the base 40. The base includes a first peripheral wall 450 and a second peripheral wall 460 formed on a rear portion of the base 40. The base 40 has multiple bosses 422, 442 respectively formed on a top of the first peripheral wall 450 and a bottom of the second peripheral wall 460. A rear portion of the insulating body 30 is mounted around the terminal set 60 and abuts against the first peripheral wall 450 and the second peripheral wall 460. The insulating body 30 is received in the housing space 22 of the shell 20. Meanwhile, the upper elastic seat 35, the lower elastic seat 36, the upper insulating film 33 and the lower insulating film 34 are respectively mounted on the top wall and a bottom wall of the insulating body 30 and are received in the housing space 22.

The shell 20 has multiple fixing holes 222, 242 respective formed through a top wall and a bottom wall of the rear drawing portion 23 to correspond to and engage the respective bosses 422, 442 on the upper base 42 and the lower base 44, such that the rear drawing portion 23 encloses the first peripheral wall 450 and the second peripheral wall 460 therein. Meanwhile, the upper and lower insulating films 33, 34, the upper and lower elastic seats 35, 36 and the insulating body 30 are all received in the housing space 22 of the shell 20 in generation of the electrical connector in accordance with the present invention.

When the electrical connector is connected to a female connector, contact tongues of the female connector are inserted into the housing space 22 of the shell 20. The multiple elastic pieces 352, 362 serve to hold the contact tongue of the female connector. The curved ends of the multiple terminals of the upper terminal set 62 and the lower terminal set 64 serve to be in touch with contacts formed on the contact tongue of the female connector so as to form a signal transmission path. Because the curved ends of the multiple terminals of the upper terminal set 62 and the lower terminal set 64 are respectively mounted in the upper guiding slots 322 and the lower guiding slots 324 of the insulating body 30 and the upper guiding slots 322 and the lower guiding slots 324 respectively correspond to the upper opening 356 and the lower opening 366, when the electrical connector is connected the female connector, the contact tongues of the female connector force the curved ends of the multiple terminals in the upper terminal set 62 and the lower terminal set 64 to be respectively pushed upwards and downwards. Given the upper guiding slots 322 and the lower guiding slots 324 as well as the upper opening 356 and the lower opening 357, a free space is provided to allow the curved ends of the multiple terminals in the upper terminal set 62 and the lower terminal set 64 to be slightly moved upwards and downwards.

After being moved upwards and downwards, the curved ends of the terminals of the upper terminal set 62 and the lower terminal set 64 eventually abut against the upper insulating film 33 and the lower insulating film 34 respectively. The upper insulating film 33 and the lower insulating film 34 serve to electrically insulate the terminals of the upper terminal set 62 and the lower terminal set 64 from the shell 20. Besides, after being moved upwards and downwards, the curved ends of the terminals of the upper terminal set 62 and the lower terminal set 64 penetrate through the upper opening 356 of the upper elastic seat 35 and the lower opening 366 of the lower elastic seat 36 and will not contact the upper elastic seat 35 and the lower elastic seat 36 to electrically connect with the upper elastic seat 35 and the lower elastic seat 36. Accordingly, upon signal transmission the upper terminal set 62 and the lower terminal set 64 are not affected by the shell 20 or the upper elastic seat 35 and the lower elastic seat 36 and thus avoid noise generation.

Figure 6:
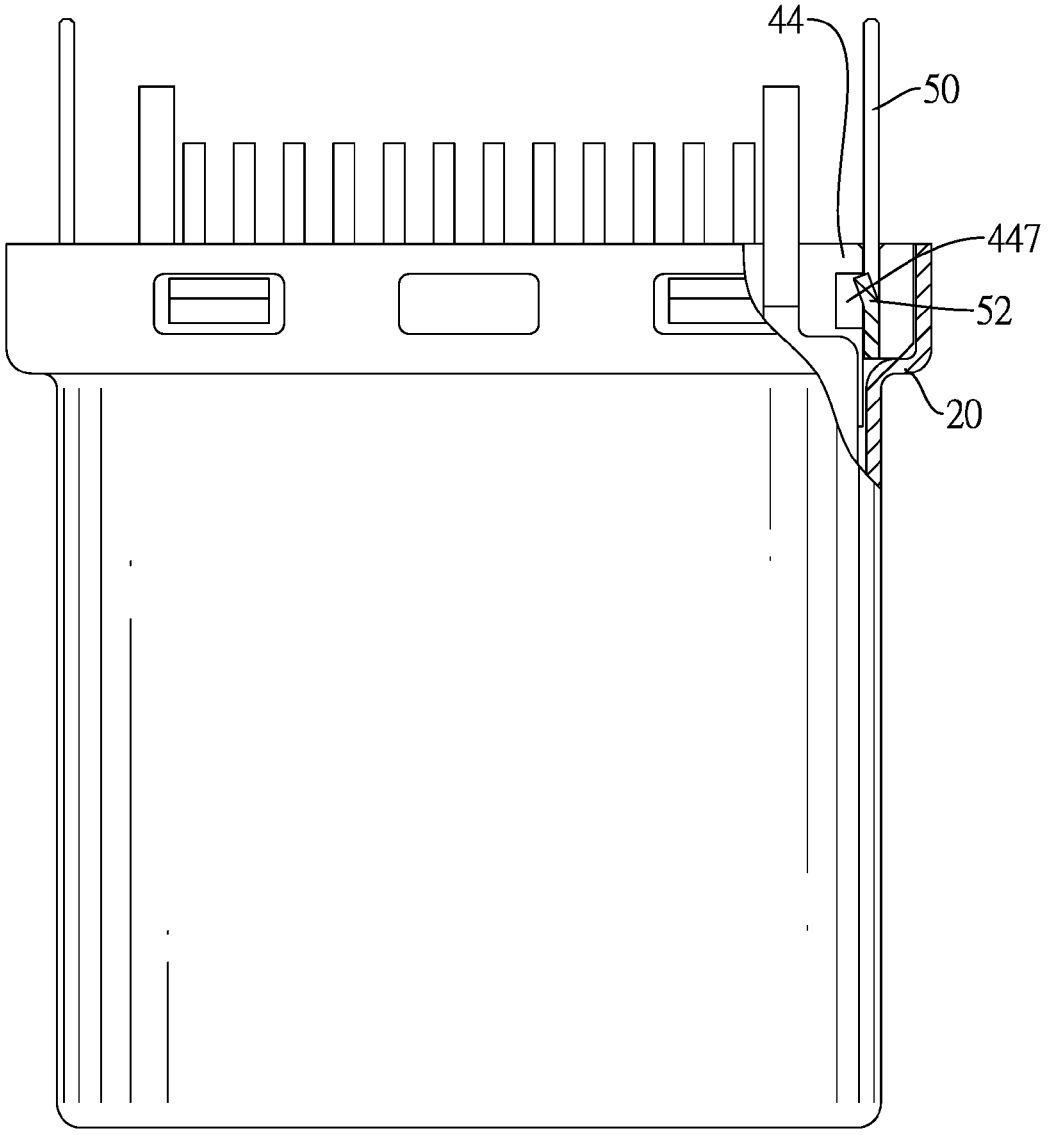
FIG. 6 is a partial cross-sectional view of the electrical connector in FIG. 2.
Figure 7:
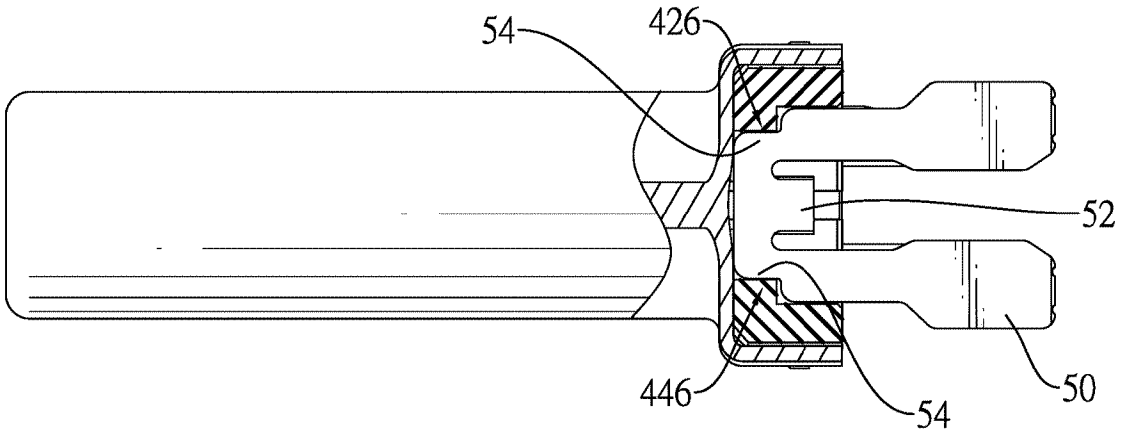
FIG. 7 is another partial cross-sectional view of the electrical connector in FIG. 2.

With reference to FIGS. 6 and 7, detailed description about how the holding pieces 50 are combined with the holding piece slots 425, 445 of the upper base 42 and the lower base 44 is illustrated. Each holding piece slot 425, 455 has a shoulder block 426, 446 and a buckle slot 427, 447. The shoulder block 426, 446 is formed on a bottom wall of the holding piece slot 425, 445. The buckle slot 427, 447 is formed in an inner sidewall of the holding piece slot 425, 445. Each holding piece 50 has a shoulder portion 54 and a buckle piece 50. The shoulder portions 54 are formed on an upper side and a lower side of a front end of the holding piece 50. The buckle piece 52 is formed on and protrudes rearwards from an inner side of the front end of the holding piece 50. When the two holding pieces 50 are respectively assembled into the upper base 42 and the lower base 44, the two buckle pieces 52 are inserted into the respective buckle slots 427, 447 and abut against rear walls of the respective buckle slots 427, 447, such that the holding pieces 50 cannot be pulled rearwards. Meanwhile, the shoulder blocks 426, 446 of the holding piece slots 425, 445 abut against the respective shoulder portions 54 of the holding pieces 50 to disallow the holding pieces 50 to be pushed forwards. Given the buckle pieces 52 corresponding to the buckle slots 427, 447 and the shoulder portions 54 corresponding to the shoulder blocks 426, 446, the holding pieces 50 are firmly fixed in the respective holding piece slots 425, 445.

Figure 8:
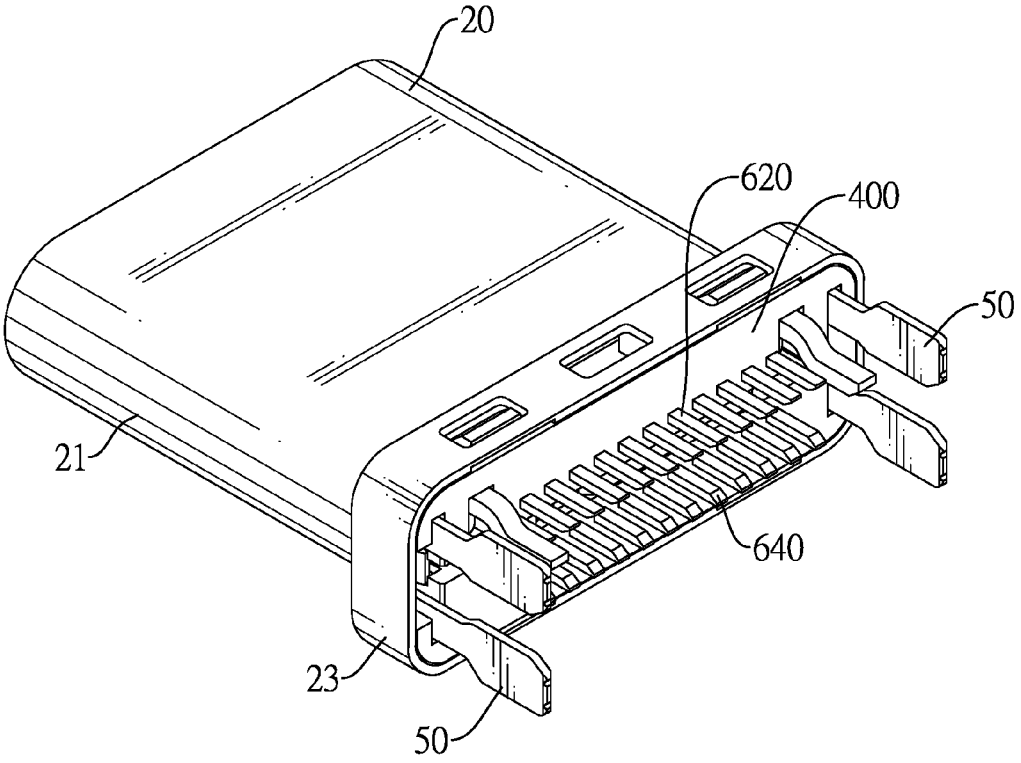
FIG. 8 is a perspective view of a second embodiment of an electrical connector in accordance with the present invention.
Figure 9:
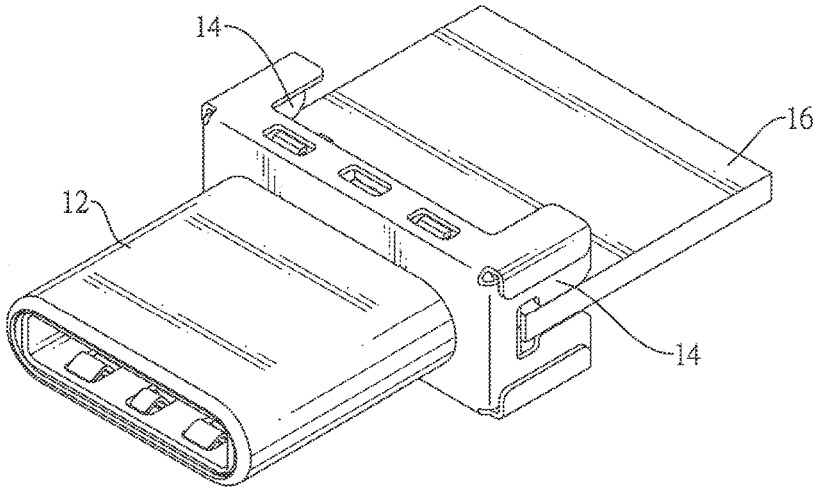
FIG.9 PRIOR ART
FIG. 9 is a perspective view of a conventional electrical connector.

With reference to FIG. 8, a second embodiment of the present invention is shown as FIG. 8. The second embodiment differs from the foregoing embodiment in that the terminals of the upper terminal set 620 and the lower terminal set 640 correspond to each other based on vertical symmetry. In other words, the terminals of the upper terminal set 620 is equal to the terminals of the lower terminal set 640 in number. In view of the difference, the upper guiding slots 322 also correspond to the lower guiding slots 324 based on vertical symmetry, and the upper through holes 350 and the lower through holes 360 of the insulating body also correspond to each other based on vertical symmetry. Similarly, the upper and lower terminals sets 620, 640 and the base 400 are formed by an insert-molding process same as that in the first embodiment. The terminals of the upper terminal set 620 are the same as those of the lower terminal set 640 in number.

In sum, the electrical connector in accordance with the present invention allows the holding pieces for holding a circuit board in connection with the electrical connector to be assembled with the base of the electrical connector. Because of the two-stage drawing process for making the shell, overall strength of the shell is enhanced to facilitate the electroplating process afterwards.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector comprising:

a base having two holding piece slots respectively formed in both sides of the base;

a terminal set having multiple terminals with one end of each terminal mounted inside the base;

a pair of holding pieces, each holding piece having a notch formed in a rear end thereof for holding a circuit board, wherein a front end of each holding piece is mounted into one of the two holding piece slots of the base;

an insulating body having an insertion space to receive the terminal set, wherein one end of the insulating body is connected with the base; and a shell having:

a rear end combined with the base;

a housing space defined inside the shell to receive the insulating body;

a front drawing portion; and a rear drawing portion formed on a rear end of the front drawing portion.

2. The electrical connector as claimed in claim 1, wherein the rear drawing portion and the front drawing portion are integrally formed and the rear drawing portion is ring-shaped.

3. The electrical connector as claimed in claim 1, wherein a cross-sectional area of the rear drawing portion is greater than that of the front drawing portion.

4. The electrical connector as claimed in claim 1, wherein the terminal set has:

an upper terminal set having multiple terminals; and a lower terminal set having multiple terminals;

wherein one end of each terminal of each of the upper terminal set and the lower terminal set is mounted inside the base, and the terminal of the lower terminal set is less than the upper terminal set in number.

5. The electrical connector as claimed in claim 1, wherein the base includes:

an upper base and a lower base correspondingly combined with the upper base, and each of the upper base and the lower base has a pair of holding piece slots respectively formed in a left portion and a right portion on a rear end of a corresponding one of the upper base and the lower base; and a shielding piece held between the upper base and the lower base.

6. The electrical connector as claimed in claim 1, wherein the base has a first peripheral wall and a second peripheral wall formed on a rear portion of the base;

the insulating body has two assembling slots respectively formed in a left side and a right side of the insulating body; and the shielding piece has two elastic inserts respectively and forwardly elongated from a left side and a right side of the shielding piece and inserted into the respective assembling slots.

7. The electrical connector as claimed in claim 1, wherein the base has multiple bosses respectively formed on a top of the first peripheral wall and a bottom of the second peripheral wall; and the shell has multiple fixing holes respective formed through a top wall and a bottom wall of the rear drawing portion to correspond to and engage the respective bosses on the upper base and the lower base, wherein the rear drawing portion encloses the first peripheral wall and the second peripheral wall therein.

8. The electrical connector as claimed in claim 5, wherein the shielding piece has a shielding body with a pair of circular holes formed through the shielding body;

the upper base has a pair of round columns formed on an inner surface of the upper base; and the lower base has a pair of circular slots formed in the inner surface of the lower base to correspond to the respective round columns of the upper base, wherein the pair of round columns are mounted through the pair of circular holes of the body and are inserted into the circular slots of the lower base.

9. The electrical connector as claimed in claim 1, further comprising:

an upper elastic seat and a lower elastic seat symmetrically placed on an upper surface and a lower surface of the insulating body respectively, wherein each of the upper elastic seat and the lower elastic seat has:

multiple insertion tabs formed on two edge portion on a top wall of a corresponding one of the upper elastic seat and the lower elastic seat; and multiple elastic pieces respectively formed on a front end of a corresponding one of the upper elastic seat and the lower elastic seat; and an opening formed through the corresponding one of the upper elastic seat and the lower elastic seat; and the insulating body has:

multiple upper through holes and multiple lower through holes respectively formed through front portions of the top wall and the bottom wall of insulating body for the multiple elastic pieces of the upper elastic seat and the lower elastic seat to be respectively mounted through the upper through holes and the lower through holes; and multiple insertion holes formed in the top wall and the bottom wall of the insulating body for the insertion tabs of the upper elastic seat and the lower elastic seat to be inserted into the respective insertion holes.

10. The electrical connector as claimed in claim 1, wherein the insulating body further has multiple upper guiding slots and multiple lower guiding slots respectively formed in a top wall and a bottom wall of the insulating body, and corresponding to the multiple terminals of the upper terminal set and lower terminal set.

11. The electrical connector as claimed in claim 1, wherein each holding piece slot has:

a shoulder block formed on a bottom wall of the holding piece slot; and a buckle slot formed in an inner sidewall of the holding piece slot; and each holding piece has:

a shoulder portion formed on an upper side and a lower side of a front end of the holding piece for the shoulder block of a corresponding holding piece to abut against the shoulder portions of the holding piece to prevent the holding piece from being pushed forwards; and a buckle piece formed on and protruding rearwards from an inner side of the front end of the holding piece, inserted into a corresponding buckle slots, and abutting against a rear wall of the corresponding buckle slot to prevent the holding pieces from being pulled rearwards.

12. The electrical connector as claimed in claim 1, further comprising:

an upper insulating film placed on an upper surface of the upper elastic seat to cover the opening of the upper elastic seat; and a lower insulating film placed on the lower surface of the lower elastic seat to cover the opening of the lower elastic seat.

* * * * *